US007328557B2

(12) United States Patent
Gertitschke et al.

(10) Patent No.: US 7,328,557 B2
(45) Date of Patent: Feb. 12, 2008

(54) APPARATUS FOR LOADING SMALL OBJECTS INTO BLISTERS OF A FOIL WEB

(75) Inventors: Detlev Gertitschke, Laupheim (DE); Wolfgang Krahl, Laupheim (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 0 days.

(21) Appl. No.: 11/581,789

(22) Filed: Oct. 16, 2006

(65) Prior Publication Data

US 2007/0084141 A1 Apr. 19, 2007

(30) Foreign Application Priority Data

Oct. 17, 2005 (DE) ..... 10 2005 049 882

(51) Int. Cl.
*B65B 35/30* (2006.01)
*B65B 5/06* (2006.01)

(52) U.S. Cl. ..... 53/539; 53/246; 53/247; 198/465.1; 198/795

(58) Field of Classification Search ..... 53/246, 53/247, 250, 251, 539
See application file for complete search history.

(56) References Cited

U.S. PATENT DOCUMENTS 3,014,321 A * 12/1961 Lesch ..... 53/579
4,693,057 A 9/1987 Rittinger
4,699,559 A 10/1987 Bibbo
4,823,539 A * 4/1989 Kuckhermann et al. ..... 53/579
5,379,575 A * 1/1995 Focke et al. ..... 53/543

FOREIGN PATENT DOCUMENTS

| | | |
|---|---|---|
| DE | 199 26 893 | 12/2000 |
| GB | 2 317 869 | 8/1998 |
| WO | 2005/075293 | 8/2005 |

* cited by examiner

*Primary Examiner*—John Sipos
(74) *Attorney, Agent, or Firm*—Andrew Wilford

(57) ABSTRACT

An apparatus for loading small objects into respective blisters of a foil web has a plurality of substantially identical fill plates each having an array of receptacles corresponding to the blisters of an area of the foil. A conveyor moves the fill plates one after another in a transport direction at an upper level from a fill station remote from the web to a transfer station close to the web, then lowers them to a lower level, then returns them in an opposite return direction from the transfer station to the fill station, and finally raises them in the transfer station to the upper level. At the fill station the receptacles of the plates are filled with the small objects. At the transfer station the small objects are taken out of the receptacles of the plates and put into the blisters of the web.

16 Claims, 3 Drawing Sheets

APPARATUS FOR LOADING SMALL OBJECTS INTO BLISTERS OF A FOIL WEB

FIELD OF THE INVENTION

The present invention relates to an apparatus for loading small objects into the blisters of a foil web. More particularly this invention concerns making blister packs of pills, capsules, tablets, or the like.

BACKGROUND OF THE INVENTION

In the manufacture of blister packs, it is necessary to accurately feed and deposit small objects, such as tablets, coated tablets, capsules or the like into the blisters of a foil web. This is done with a fill plate provided with receptacles arranged in a pattern corresponding to the pattern or array of the blisters in the foil web and with a transfer plate for transferring the small objects from the fill plate to the foil web.

Such an apparatus is known from DE 199 26 893 that has proven to be effective in practice, the reliable operation mode of which, however, goes hand in hand with a comparatively strong limitation regarding performance, since the extra small objects placed on the fill plate have to be continuously shifted from the fill plate in order to maintain undisturbed access to the receptacles.

OBJECTS OF THE INVENTION

It is therefore an object of the present invention to provide an improved apparatus for loading small objects into blisters of a foil web.

Another object is the provision of such an improved apparatus for loading small objects into blisters of a foil web that overcomes the above-given disadvantages, in particular that operates in a relatively simple manner, and that can be readily adapted to foils with different arrays of blisters.

SUMMARY OF THE INVENTION

An apparatus for loading small objects into respective blisters of a foil web. The apparatus has according to the invention a plurality of substantially identical fill plates each having an array of receptacles corresponding to the blisters of an area of the foil, transport means for conveying the fill plates one after another in a transport direction at an upper level along a horizontal upper conveyor stretch from a fill station remote from the web to a transfer station close to the web. Then lowering them to a lower level of a horizontal lower conveyor stretch below the upper stretch. Then returning them along the lower stretch in an opposite return direction from the transfer station to the fill station, and finally raising them in the transfer station to the upper level, filler at the fill station for filling the receptacles of the plates at the upper level in the fill station with the small objects, and transfer means at the transfer station for taking the small objects out of the receptacles of the plates at the upper level in the transfer station and putting the objects into the blisters of the web.

Such an apparatus is advantageous since there is more time at available for the correct filling of the receptacles of a fill plate, since the time required for the transfer from the fill station into the delivery position and also for the transfer of the small objects from the receptacles in the fill plate to the blisters in the foil web can be used to process a different fill plate in the fill station. Furthermore, the apparatus is characterized in that it requires only a small amount space, since the return movement of the empty fill plates is just below the upper transport level of the full plates, and it os only necessary to drop the plates a little, a little more than the plate thickness, to send them back to the fill station.

A preferred apparatus with respect to simplicity of assembly is characterized in that a respective lifting table that can be raised and lowered is provided in both the transfer station and the fill station, with a chain or belt-type conveyor extending between them at the lower level. The required movement of the fill plates, after the transfer of the objects to the web, is comprised of first lowering the plates below the upper filling/transfer level, moving them opposite the transport direction from the transfer station to the fill station, and finally lifting them is effected by three separate devices so that the flexibility is very high and especially the movement in the opposite direction to the feeding direction can also be carried out at a high speed (compared to the slow speed of movement downstream) in order to thus gain time for a further treatment of the fill plate which is fed back into the fill station.

It has proven to be provide an abutment or stop on the lifting table for the fill plate in order to thus guarantee that the fill plate is lifted by the lifting table just when the plate has reached the designated position, so that a collision with different components, in particular other fill plates situated on the feeding level, is avoided.

Regarding the simplicity of the assembly and regarding its reliability, it is furthermore convenient when the lifting tables and/or the transport means at the upper level at least are powered with the help of fluid pressure, particularly by means of a pneumatic drive.

In order to feed a plurality of fill plates in a way as simple as possible, the fill plates ride on lockable edge rails for combined feeding in feed direction. Alternatively to the use of a pneumatic drive there is also the possibility of providing servomotors for operating the lifting tables and/or the edge rails and/or the fill plates.

For improved performance, it is furthermore advantageous if filling elements are provided above the fill plates on the feeding level between the fill station and the transfer station. The filling elements assist the filling of the small objects into the receptacles in the fill plates, that is, in the fill station they help the small objects which have fallen next the receptacles on the upper face of the fill plate in finding the receptacles.

Thus, it is advantageous when the filling element is formed by a brush that is rotated, the rotation axis of the brush being oriented transverse to the feed direction, such that, on the one hand, the brush can be used to sweep the small objects transversely to the feed direction, or on the other hand, with the rotation axis oriented differently, it may be used to move the objects direction to the feed or transport direction.

Alternatively, it is also possible that the filling element is formed by a strip arranged transversely to the feed direction, which can also be seen as nonrotating brush that stops further movement of the small objects on the surface of the fill plates in the feed direction, thus preventing the small objects placed on the surface of the fill plates from disturbing the operation of the transfer plate. It is furthermore advantageous, when a vibratory drive is connected to the fill plates so as to rattle off any small objects that are not in receptacles, and to encourage the objects to travel across the plates and fill all the receptacles, which typically are dimensioned to fit fairly snugly around the object and only hold one of them.

It is furthermore convenient when the fill plates on the feeding level are at the same height as the foil web, since this way the transfer plate can move along a minimal path when transferring the small objects from the receptacles of the fill plate into the blisters in the foil web.

It is recommended to provide the transfer plate with an array of suction grippers to pick the small objects up out of the receptacles in the fill plate and then, after the transfer plate has shifted downstream into a position above the blister web, release the suction to drop the objects into the respective blisters.

A second suction device can be provided for cleaning the fill plates once they have been emptied of small objects to as to avoid problems of particles of the objects or the like building up in the plate receptacles and interfering with use of the fill plates. Such a suction device is provided normally somewhere along the lower level along which the plates are returned to the fill station.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
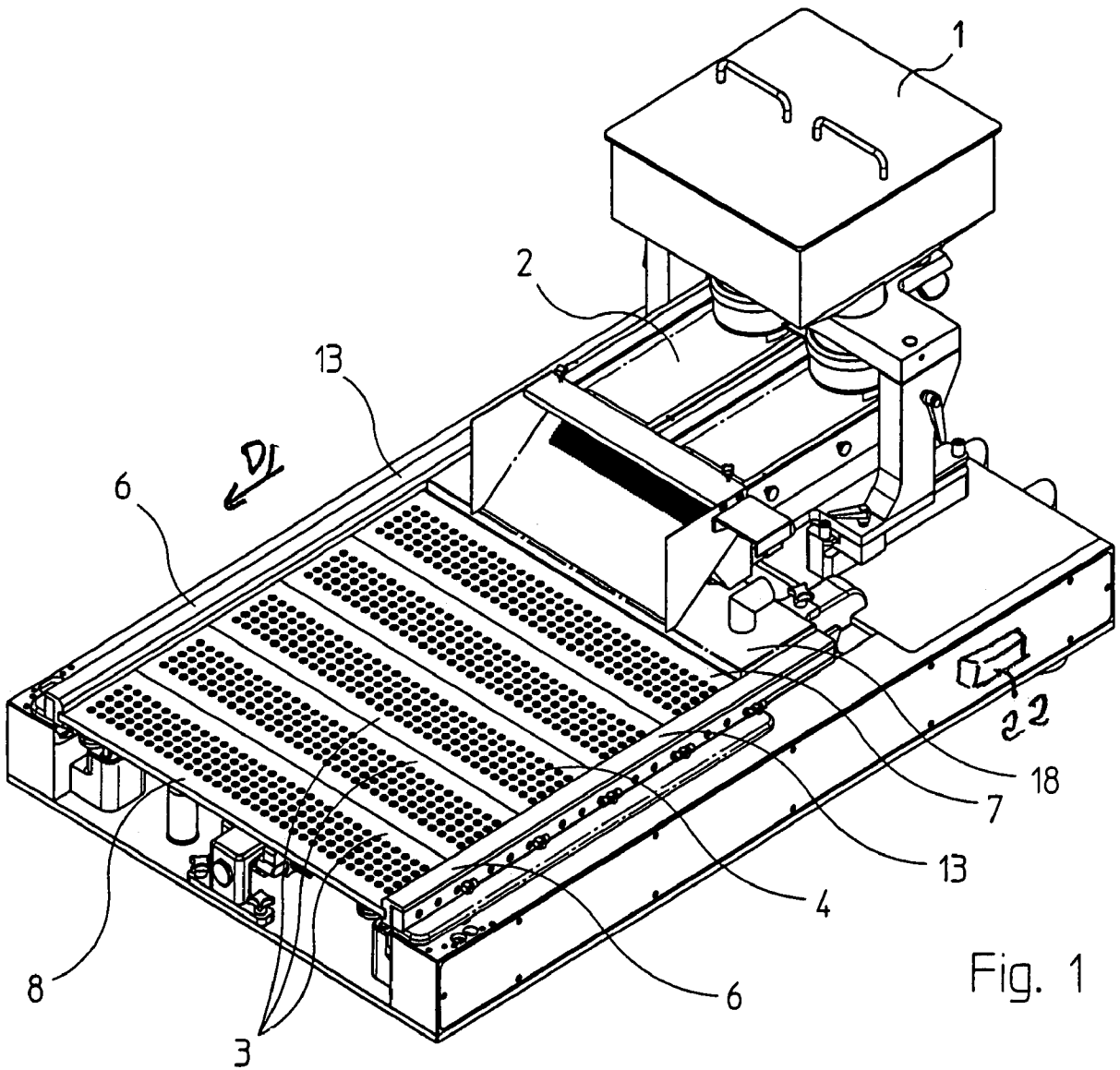
FIG. 1 is a perspective view of an apparatus according to the invention
Figure 2:
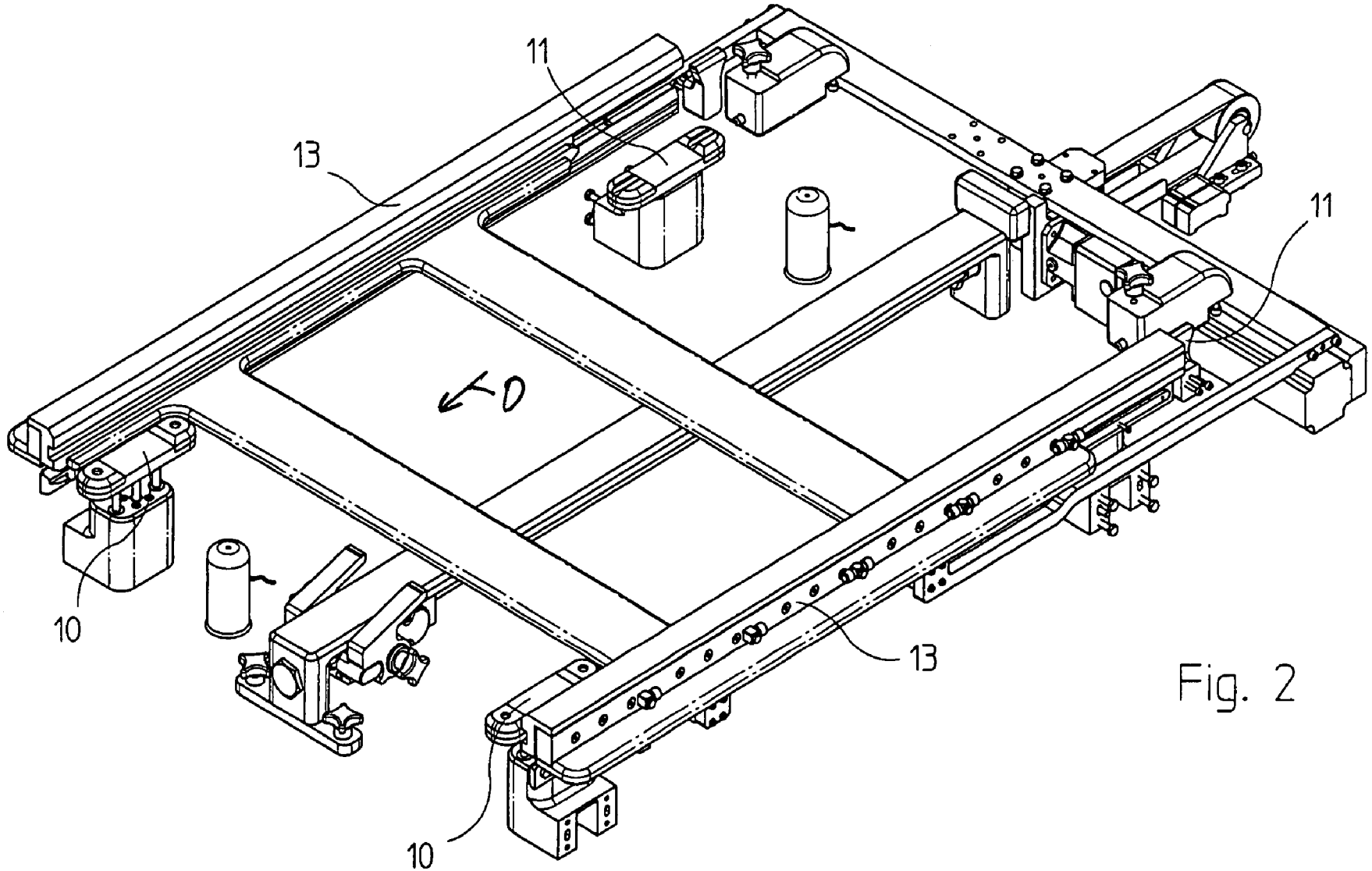
FIG. 2 is a perspective view of the framework of the apparatus according to the invention without its housing.

As seen in the drawing small objects O (FIG. 3) to be packaged can be pills, tablets, coated tablets, capsules or the like. These small objects O are taken from a supply 1 and transferred to a fill plate 3 by means of a dosing channel 2.

The fill plate 3 has receptacles 4 that are arranged in a pattern corresponding to the pattern of the blisters in a foil web 5 into which the small objects O are to be transferred. The fill plate 3 itself can be moved by means of a transport apparatus 6 from an upstream fill station 7 to a downstream transfer station 8. A plurality of fill plates 3 are aligned in a row on an upper transport level U and displaced downstream in a feed direction D. In the transfer station 8 the corresponding fill plate 3 interacts with a transfer plate 9 having small suction grippers 23 that can pick up the small objects O from the receptacles 4 in the fill plate 3 can transfer them into the blisters of the foil web 5.

Once a plate 3 has been emptied by the transfer device 9 of the small objects O, this fill plate 3 is lowered by means of a vertically shiftable lifting table 10 below the feeding level U of the other fill plates 3, and then moved by another conveyor 19 in a reverse return direction R opposite to the feed direction D, and finally a second lifting table 11 lifts the empty plate 3 in the fill station 7 to the feed level U. Thus, the fill plates 3 move in an endless path having a horizontal upper stretch at the level U, a horizontal lower stretch at the lower level U, and two short vertical stretches at the stations 7 and 8. The movement of the fill plates 3 can be continuous or stepwise. Here the movement is stepwise at the upper level U and continuous in the lower level L. The conveyor 19 in the embodiment (FIG. 3) shown in the drawing is simply formed by a continuously moving transportation belt 12, on whose upper reach the fill plates 3 are positioned. A horizontally effective reciprocal pneumatic pusher 17 serves to shift the row of plates 3 downstream in the direction D at the level U.

Edge rails 13 are provided that engage longitudinal outer edges of the plates 3. These rails 13 can in fact be of horizontally open U-shape, confronting each other, and can also be set to grip and solidly hold the plates between conveyor steps when they are pushed downstream.

Figure 3:
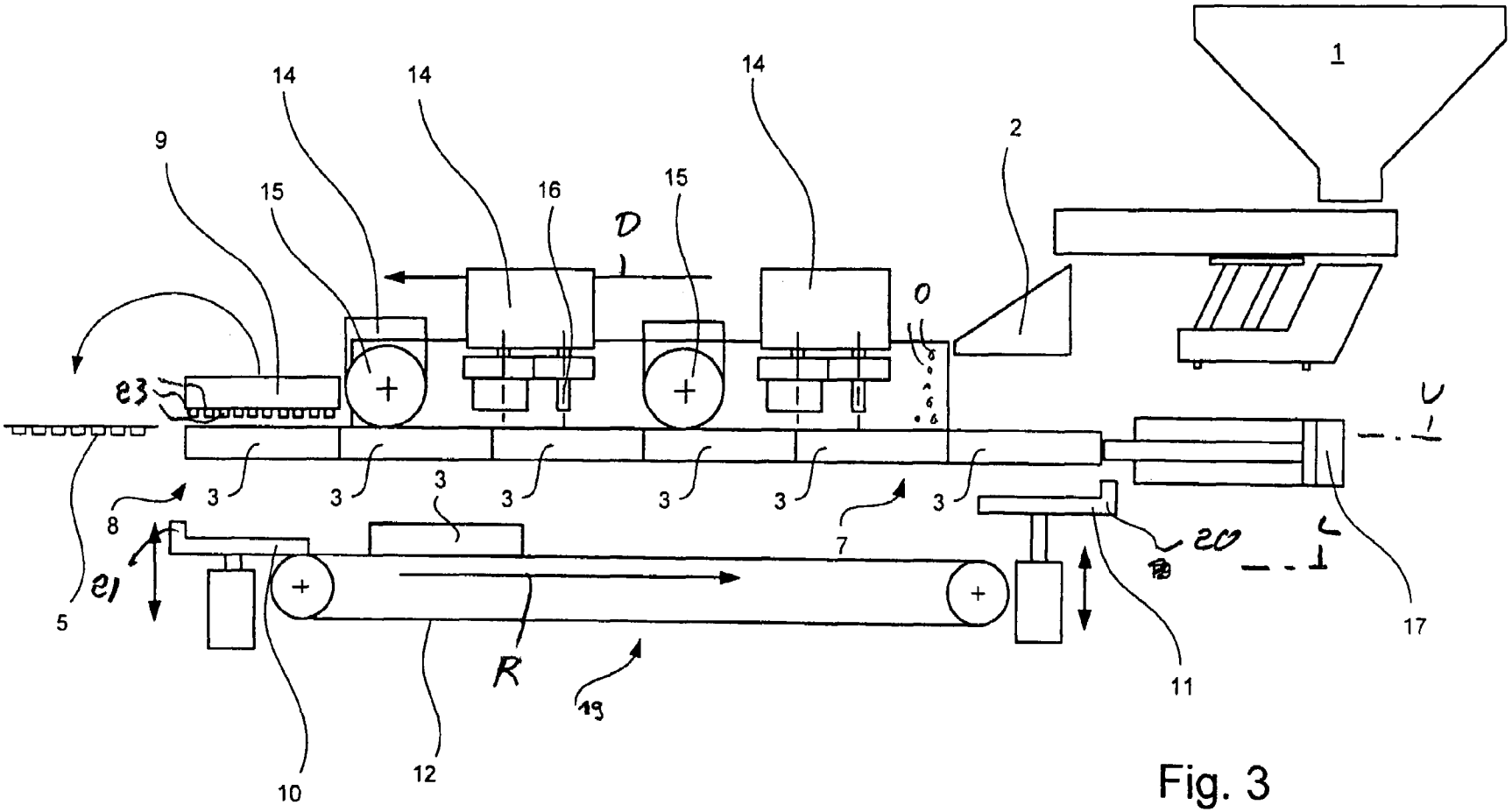
FIG. 3 is a schematic side view of the apparatus according to the invention.

FIG. 3 shows that filling elements 14 are arranged above the fill plates 3 on the feed level U between the fill station 7 and the transfer station 8. The filling elements 14 are two brushes 15 which can be rotationally driven, with rotation axes perpendicular to the feed direction D and in parallel position to the plane defined by the fill plates 3. Furthermore, a loading-element stirrer 16 is provided that has a vertical rotation axis so that this stirrer 16 laterally distributes the small objects O lying on the fill plates 3. The sorting of the small objects O into the receptacles 4 in the fill plates 3 is supported by a vibratory drive 23 secured to one or both of the rails 13.

The transfer-station table 10 and the loading-station table 11 are provided respectively at their (relative to the direction D) downstream and upstream ends with abutments 21 and 20 that ensure proper alignment of the plates 3 when being lowered and raised. This is particularly important for the upstream table 11 in that it ensures that the fast and continuously operating conveyor 19 will shift the plates 3 upstream to the proper position and bump them into place for perfect raising into the loading station 7.

FIG. 3 shows furthermore that the fill plates 3 on the feed level U are on the same level as the foil web 5, so that the transfer plate 9 designed as a suction plate only has to move through a small distance to transfer the small objects O from the receptacles 4 into the blisters. It should be furthermore noted that a second suction plate 18 is provided for the cleaning of the fill plates 3 after removal of the small objects O from the plates 3. This suction plate 18 is active directly before the fill station 7 and thus ensures complete cleaning before the fill plates 3 are reintegrated into the filling process.

With the apparatus according to the invention any kind of foils can be filled in combination with a validation of the cleaning and a simple format adjustment may be carried out by switching the fill plates 3 and the transfer plate 9.

We claim:

1. An apparatus for loading small objects into respective blisters of a foil web, the apparatus comprising:

a plurality of substantially identical fill plates each having an array of receptacles corresponding to the blisters of an area of the foil;

transport means for conveying the fill plates one after another in a transport direction at an upper level along a horizontal upper conveyor stretch from a fill station remote from the web to a transfer station close to the web;

means separate from the transporting means for lowering the plates to a lower level of a horizontal lower conveyor stretch below the upper stretch;

means separate from the transporting means for returning the plates along the lower stretch in an opposite return direction from the transfer station to the fill station;

means separate from the transporting means for raising the plates in the transfer station to the upper level;

filling means at the fill station for filling the receptacles of the plates at the upper level in the fill station with the small objects; and transfer means at the transfer station for taking the small objects out of the receptacles of the plates at the upper level in the transfer station and putting the objects into the blisters of the web.

2. The loading apparatus defined in claim 1 wherein the means for lowering and raising includes at each of the stations a raisable and lowerable support.

3. The loading apparatus defined in claim 2 wherein the returning means includes a conveyor between the supports.

4. The loading apparatus defined in claim 3 wherein the conveyor runs continuously.

5. The loading apparatus defined in claim 4 wherein the transport means includes means for shifting the plates stepwise at the upper level in the upper stretch.

6. The loading apparatus defined in claim 5 wherein the stepwise shifting means is pneumatically powered.

7. The loading apparatus defined in claim 2 wherein the support at the fill station has an abutment against which the plates are engageable.

8. The loading apparatus defined in claim 2 wherein the transport means includes guide rails at the upper level extending between the stations and supporting the plates at the upper level.

9. The loading apparatus defined in claim 1 wherein the filling means includes means for distributing the small objects over upper faces of the plates.

10. The loading apparatus defined in claim 9 wherein the means for distributing includes an element sweeping over the upper faces downstream of the fill station.

11. The loading apparatus defined in claim 10 wherein the element is movable transversely of the transport direction.

12. The loading apparatus defined in claim 9 wherein the means element is at least one brush operable to sweep excess small objects off the upper faces of the plates.

13. The loading apparatus defined in claim 1, further comprising means for vibrating the plates in the upper level.

14. The loading apparatus defined in claim 1 wherein the upper level is generally level with the foil.

15. The loading apparatus defined in claim 1 wherein the transfer means includes vacuum pickups each engageable in a respective one of the receptacles of the plate in the transfer station.

16. The loading apparatus defined in claim 1, further comprising means for cleaning the plates and emptying the receptacles.

* * * * *